United States Patent [19]

Hanke

[11] 4,169,651

[45] Oct. 2, 1979

[54] CONNECTOR

[75] Inventor: Wolfgang Hanke, Obersulm, Fed. Rep. of Germany

[73] Assignee: Nopa GmbH, Kirchardt, Fed. Rep. of Germany

[21] Appl. No.: 722,206

[22] Filed: Sep. 10, 1976

[30] Foreign Application Priority Data

Apr. 15, 1976 [DE] Fed. Rep. of Germany ..... 2616621

[51] Int. Cl.[2] ..... H01R 9/08

[52] U.S. Cl. ..... 339/217 R

[58] Field of Search ..... 339/217 R, 217 J, 217 PS, 339/217 SP, 217 TP, 217 S

[56] References Cited

U.S. PATENT DOCUMENTS

| | | | |
|---|---|---|---|
| 2,158,003 | 5/1939 | Douglas | 339/217 S |
| 3,173,736 | 3/1965 | Brinkel et al. | 339/217 S |
| 3,310,771 | 3/1967 | Amigh | 339/217 J |
| 3,504,328 | 3/1970 | Olsson | 339/275 |
| 3,777,303 | 12/1973 | McDonough | 339/217 R |
| 3,815,081 | 6/1974 | Jones | 339/217 S |
| 3,941,449 | 3/1976 | Baumanis | 339/217 S |

*Primary Examiner*—Gerald A. Dost

[57] ABSTRACT

A connector including a rotation symmetric contact pin mountably received within a bore in a housing. The housing includes a stop chamber adapted to lockingly engage resilient stop springs tangentially attached to the contact pin when the pin is inserted into the bore such that the resilient stop springs extend from the contact pin into the stop chamber. Rotation of the contact pin retracts the stop springs into openings in the contact pin and permits withdrawal of the contact pin from the bore.

11 Claims, 7 Drawing Figures

CONNECTOR

Figure 1:
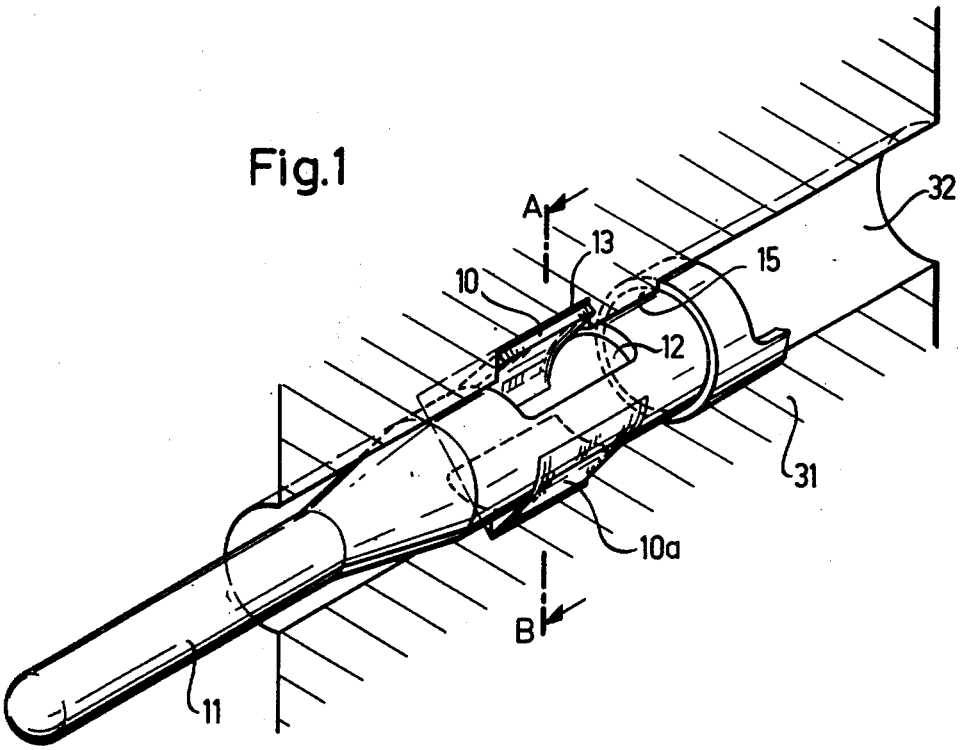

This invention relates to a connector, in particular for establishing an electric connection, comprising a substantially rotation-symmetrical contact pin and further comprising a stop spring which is secured to said contact pin and which, when said contact pin is inserted into a housing of the connection, spring-locks into position behind a housing projection.

It is generally known to use connectors to establish an electric connection in which a contact pin comprising a shaft is introduced into a housing or a barrel and establishes with its front end which is designed as a contact element an electric connection together with a corresponding part. In such a connection, it is also known to secure the contact pin in the housing by using stop springs to prevent it from falling out by locking such stop springs which generally extend opposite the contact insertion direction in the support housing, into position behind corresponding constrictions in the housing. Moreover, a stop means is generally provided in the housing which serves as an abutment for the stop springs. A serious disadvantage of such connectors has proved to be that a special removal tool must be employed to unlock the stop springs. Such a removal tool generally has the shape of a barrel which is introduced into the housing in order to press the stop springs onto the contact pin so that the contact pin can be withdrawn out of the support housing thereafter. The removal of contact pins from the support housing with the aid of such a tool means additional expense and its manipulation is relatively complicated. Another drawback of such a known arrangement is that an additional space must be provided between the contact pin and the support housing for the barrel which must be slid over the contact pin in order to unlock the contacts and this enlarges the entire assembly considerably. The spacing between the contact pin and the housing is not determined by the technical finishing tolerances, but is determined substantially by the dimensions of the removal tool. This drawback is a particular nuisance especially if a large plurality of contacts is to be accommodated in a relatively small space.

The object of the invention is thus to provide a connector of the type cited at the outset which is designed such that an especially large plurality of connectors can be accommodated in an extraordinarily small space and which can be released without the use of a tool.

This object is accomplished in accordance with the invention in that the stop spring is at least one tab which is spread beyond the external skirt of the contact pin in the circumferential direction of said pin and that the contact pin has a recess into which the tab can be pressed against the spring force of its own inherent elasticity at least so far that the outer surface of the tab is flush with the skirt surface of said contact pin.

Advantageous further developments and preferred embodiments of the subject matter of the invention are evident in the subclaims.

The essential advantage can be achieved in accordance with the invention that the stop springs can be released by a slight manual rotation of a contact pin designed in accordance with the invention, whereupon the contact pin can be withdrawn from the housing without difficulty.

It has proved to be advantageous also in the inventive assembly that the stop springs are elastically deformed only briefly during insertion of a contact pin, while the stop springs are subject to practically no strain in the locked state, thereby ensuring absolutely reliable locking even after a longer period of operation without there being any danger of the connector being released unintentionally during violent vibration or/shock.

A material can beused for the stop springs designed in accordance with the invention which has elasticity properties on which high demands cannot be made. The stop springs are only subject to those thrust loads, when the connector is in the locked state, which can be absorbed with absolute certainty in the event of an excessive tension load exerted on the contact pin or the cable connected thereto.

Since the inventive stop springs are necessarily depressed into their corresponding recess in the contact pin during rotational movement executed to release said pin, reliable unlocking is also ensured even if the stop springs should be deformed by improper handling. Hence, there is no possibility for a connector not to release itself in the case of the inventive arrangement if the connector has been damaged by excessive loads or any other type of impairment.

Moreover, the inventive means is also extraordinarily simple in construction and production, since it can be manufactured as a punch-bend part in a large-scale automatic series production with extraordinarily low production costs.

Figure 3A:
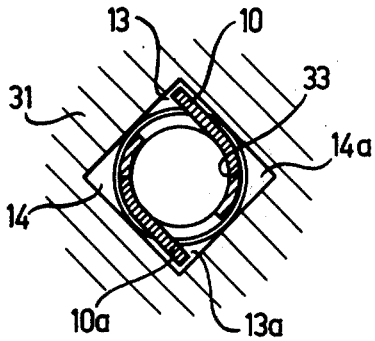
Figure 3B:
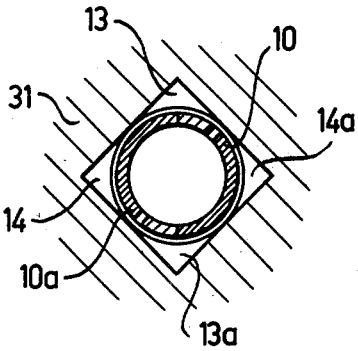
Figure 2:
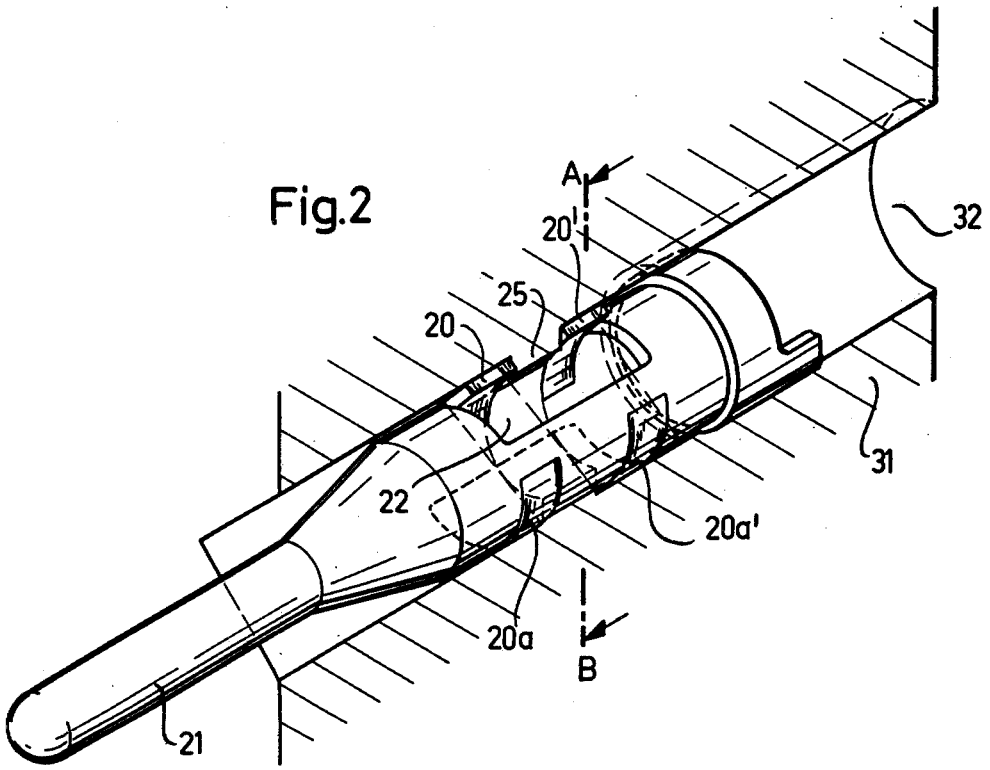
Figure 4A:
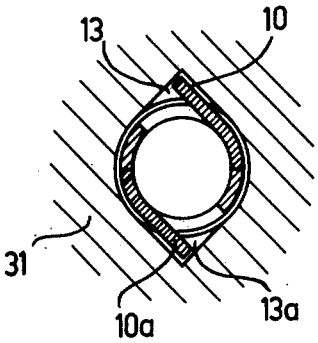
Figure 4B:
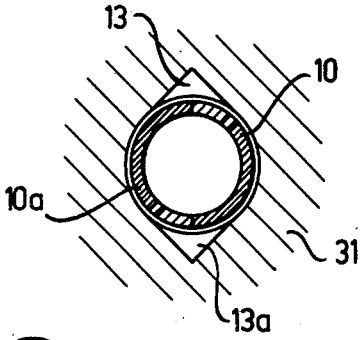
Figure 5:
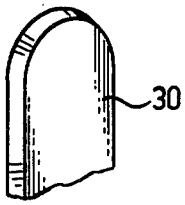

The invention will now be described in the following by way of example with reference to the drawing in which:

FIG. 1 is a perspective elevation in partial cross section of a first preferred embodiment of the subject matter of the invention, FIG. 2 is a perspective elevation in partial cross section of a second preferred embodiment of the subject matter of the invention, FIG. 3*a* is a section along the line A–B in FIG. 1 in which the housing has four stop chambers and the stop springs are illustrated in their locked state, FIG. 3*b* is a section along the line A–B in FIG. 1 in which the housing has four stop chambers and the stop springs are illustrated in their unlocked state, FIG. 4*a* is a section along the line A–B in FIG. 2 in which the housing has two stop chambers and the stop springs are illustrated in their locked state, FIG. 4*b* is a section along the line A–B in FIG. 2 in which the housing has two stop chambers and the stop springs are illustrated in their unlocked state, and FIG. 5 is a perspective partial elevation of the free end of yet another embodiment of a stop spring.

According to FIG. 1, the housing 31 has a bore 32. A section through the center line of the bore 32 is illustrated in the drawing. A contact pin 11 has been inserted into the bore 32 and has at its leading end a cylindrical contact element which serves to establish an electric connection with a corresponding part. This contact element which is disposed at the front portion of the contact pin 11 has a smaller diameter than the bore 32. The contact element is connected at the rear to a shaft having a larger diameter which can be inserted into the bore 32 is a sliding fit. At its rear end, the contact pin 11 has a terminal for an electric cable which is illustrated in a broken away manner. The connection between the contact pin 11 and the electric cable can be made in any suitable manner, e.g. by crimping.

The shaft of the contact pin 11 is preferably produced as a punch-bend part. Stop springs designed as tabs 10 and 10*a* are attached to the punch-bend part, preferably by welding. The tabs 10 and 10*a* are preferably welded onto the area of the contact pin 11 illustrated in FIG. 3*a* at 33.

The tabs 10 and 10*a* project tangentially from the contact pin 11 when they are subject to no load. The tabs 10 and 10*a* in FIG. 1 are illustrated in the position which they assume when the contact pin 11 is inserted into the bore 32 and the tabs 10 and 10*a* lock into position in the stop chambers 13 and 14 behind the projection 15.

FIG. 2 shows an arrangement similar to that in FIG. 1 which, however, in contradistinction to the means illustrated in FIG. 1, has two pairs of tabs 20, 20*a* and 20', 20*a'* along the axis of the contact pin 21. These tabs respectively lock in front of or behind a projection 25 in corresponding stop chambers. Moreover, the structure of the means according to FIG. 2 is identical to that illustrated in FIG. 1. In the following, the release or unlocking of the stop springs will be explained with reference to FIGS. 3 and 4 for the embodiments illustrated in FIGS. 1 and 2.

It is evident from the cross section illustrated in FIG. 3*a* that a substantially quadratic recess in present in the housing 31 which defines in its corner areas the stop chambers 13, 13*a* and 14, 14*a*. FIG. 3*a* illustrated the locked state of the tabs 10 and 10*a* which project into the stop chambers 13 and 13*a*. In order to unlock the stop springs, the contact pin is rotated clockwise into the position shown in FIG. 3*b* with the free ends of the stop springs lying down in the area of the circumference of the contact pin so that the tabs 10 and 10*a* no longer project beyond the outer periphery of the skirt of the contact pin and thus do not stick out beyond the inner periphery of the bore 32. Hence, the contact pin 11 and 21 can be withdrawn from the bore 32.

In FIGS. 4*a* and 4*b* means corresponding to those illustrated in FIGS. 3*a* and 3*b* are shown and similar structural members have been assigned the same reference numerals. In the case of the means according to FIGS. 4*a* and 4*b*, the difference over the means according to FIGS. 3*a* and 3*b* is merely that only two diametrically opposite stop chambers are present. Whereas in order to unlock the means according to FIGS. 3*a* and 3*b*, it had to be rotated approx. 90°, it is necessary to rotate the assembly according to FIGS. 4*a* and 4*b* by approx. 180° until the contact pin has been moved from the locked position illustrated in FIG. 4*a* into the unlocked position illustrated in FIG. 4*b*.

FIG. 5 illustrates in a perspective partial elevation a stop spring in which the free end of the tab 30 has been rounded off. Such a tab facilitates insertion as well as wihdrawal of said contact pin 11 or 21 because the rounded-off tab can more easily slide over obstructions and prominences in the area of the bore even after any possible deformation.

What is claimed is:

1. A connector assembly comprising:

a connector housing;

a bore in said connector housing;

a stop chamber in said bore;

a contact pin rotatably received by said bore for removingly mating with said stop chamber, said contact pin having a contact end extending from said connector housing when said contact pin is received by said bore, a terminal receiving end and at least one aperture between said contact end and said terminal receiving end; and resilient locking tab means attached, at one end, to said contact pin proximate said aperture for maintaining said contact pin in either a lock state or a release state with respect to said connector housing, said lock state comprising the engagement of said locking tab means with said stop chamber when said pin is inserted into said bore, said release state comprising the retraction of said locking tab means into said aperture when said connector pin is rotated within said bore.

2. The connector assembly of claim 1 wherein said resilient locking tab extends tangentially away from said contact pin.

3. The connector assembly of claim 2 wherein two resilient locking tabs are provided on diametrically opposite sides of said contact pin and are synchrenously extended on retracted upper rotation of said contact pin within said bore.

4. The connector assembly of claim 1 wherein the contact pin is cylindrical.

5. The connector assembly of claim 1 wherein the resilient locking tab is rounded off at its unattached end.

6. The connector assembly of claim 1 wherein the resilient locking tab is of spring steel.

7. The connector assembly of claim 1 wherein the resilient locking tab is welded onto the contact pin at said aperture.

8. The connector assembly of claim 3 wherein the housing includes four stop chambers dispersed at equal angular distances on the circumference of said bore.

9. The connector assembly of claim 3 wherein the portion of said contact pin proximate said terminal receiving end has a greater diameter than the portion proximate said contact end and wherein said resilient locking tabs are located on said enlarged portion of said contact pin.

10. The connector assembly according to claim 9 wherein each of said locking tabs has a width which corresponds approximately to the diameter of the enlarged portion of said contact pin.

11. The connector assembly of claim 4 wherein a plurality of resilient locking tabs are respectively arranged in spaced relation along the axis of said contact pin.

* * * * *